US006662474B2

(12) United States Patent
Tomat

(10) Patent No.: US 6,662,474 B2
(45) Date of Patent: Dec. 16, 2003

(54) BUTTRESS FOR SHOES

(75) Inventor: Andrea Tomat, Montebelluna (IT)

(73) Assignee: Lotto Sport Italia S.p.A., Montebelluna (IT)

( * ) Notice: Subject to any disclaimer, the term of this patent is extended or adjusted under 35 U.S.C. 154(b) by 17 days.

(21) Appl. No.: 10/032,536

(22) Filed: Jan. 2, 2002

(65) Prior Publication Data

US 2002/0112376 A1 Aug. 22, 2002

(30) Foreign Application Priority Data

Feb. 16, 2001 (IT) ..... VR2001A0019

(51) Int. Cl.[7] ..... A43B 13/42; A43B 23/08
(52) U.S. Cl. ..... 36/69; 36/68
(58) Field of Search ..... 36/68, 69

(56) References Cited

U.S. PATENT DOCUMENTS 247,787 A * 10/1881 Watson ..... 36/68
960,814 A * 6/1910 Capen ..... 36/68
1,090,106 A * 3/1914 Montine ..... 36/69

* cited by examiner

*Primary Examiner*—Ted Kavanaugh
(74) *Attorney, Agent, or Firm*—Browdy and Neimark

(57) ABSTRACT

Buttress for shoes able to be inserted in the heel area of a shoe comprising a locking portion and a yielding portion, less rigid than said locking portion. The locking portion has an upper profile provided, at least in correspondence with an area of first coupling, with a plurality of appendages projecting substantially upwards. The yielding portion has a lower profile having at least an area of second coupling that is substantially counter-shaped and coupled to the area of first coupling. The locking portion further comprises a rear area and two lateral areas (7), the rear area (6) being laterally integral with each of the lateral areas.

9 Claims, 4 Drawing Sheets

BUTTRESS FOR SHOES

BACKGROUND OF THE INVENTION

1. Technical Field of the Invention

The present invention relates to a buttress for shoes.

The buttress of the present invention is in particular destined to sports shoes and it has orthopaedic aims.

2. Prior Art

As is well known, buttresses are placed in the heel of shoes to enhance their sturdiness and at the same time assure a greater stability of the foot.

Buttresses in use today have a horse-shoe planar development, and nearly all have a growing height from the front edges towards the centre of the rear area. The need to assure good stability to the foot, however, sometimes clashes with particular physical needs.

The Achilles heel area can be subject to different pathologies and injuries. For instance, in particular—but not only—in the sporting field, tendinitis, bursitis, and even rupture of the Achilles heel, which may require surgery to heal, are a very frequent occurrence.

Persons suffering from said pathologies undergo varying measures of discomfort when they have to use shoes with traditional rigid buttresses, in particular when they participate in sporting activities.

In addition, such pathologies are sharply more frequent in athletes, in particular professional ones, who subject the Achilles tendon to greater stresses and who at the same time cannot avoid taking part in sporting activities.

Over the years, some solutions have been developed to try solving said problem.

A first solution is proposed, for instance, by patent DE 2830398, which discloses a buttress having globally traditional shape, but provided in correspondence with the area of origin of the Achilles heel with a U-shaped cavity closed with an elastic material. A second solution, disclosed in patent DE 4316228, provides for the buttress to have two lateral portions joined by a thin band of material around the base of the heel.

Both described prior art solutions, however, have drawbacks.

In regard to the first solution, wherein the buttress has a U-shaped cavity closed by a soft material, it is useful only if the lesion of the Achilles heel is located centrally on the tendon.

If the lesion is instead located laterally relative to the tendon (which is a very frequent occurrence) it is continually stressed by the rigid part of the buttress, with the risk of further aggravation. On the other hand, the cavity cannot be made too ample, or else the buttress would lose the characteristics of sturdiness which constitute the primary aim of its usage.

In regard to the second described solution, it discloses, rather than a buttress, a lateral protection system of the heel, lacking the characteristics of a buttress.

SUMMARY OF THE INVENTION

In this situation, the technical task constituting the basis for the present invention is to obtain a buttress for shoes that overcomes the aforementioned drawbacks.

In particular, a technical task of the present invention is to obtain a buttress for shoes able to be used also by persons suffering from Achilles heel pathologies, without having to forego the foot stability provided by traditional buttresses.

The specified technical task and the indicated aims are substantially achieved by a buttress for shoes, as described in the accompanying claims.

BRIEF DESCRIPTION OF THE DRAWINGS

Further characteristics and advantages of the present invention shall become more readily apparent from the detailed description of a preferred, but not exclusive embodiment of a buttress for shoes, illustrated in the accompanying drawings, in which.

DESCRIPTION OF THE PREFERRED EMBODIMENT

Figure 1:
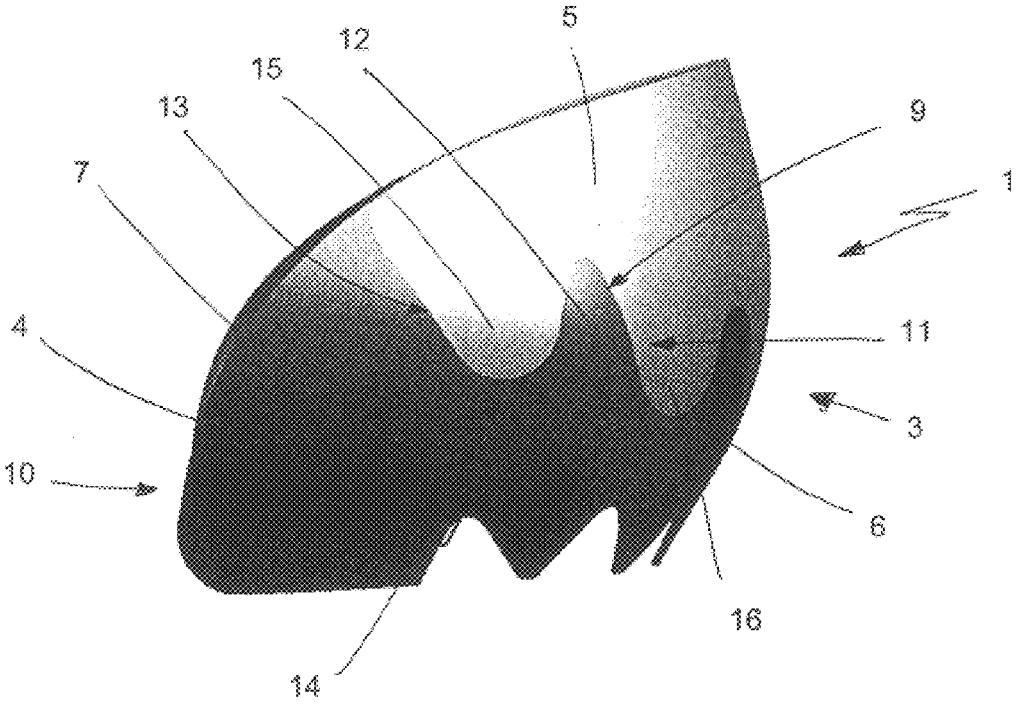
FIG. 1 is a lateral elevation view of a buttress according to the present invention.

With reference to the aforementioned figures, the reference number 1 globally indicates a buttress for shoes according to the present invention.

The buttress 1 has, if observed in plan view, a horse-shoe shape, in which an inner part 2 and an outer part 3 can be identified.

The buttress 1 comprises a locking portion 4 and a yielding portion 5 positioned above the locking portion 4 and fastened thereto.

The locking portion 4 which is, like the buttress 1, horseshoe-shaped if seen in plan view, has a rear area 6 whereto are joined the two lateral areas 7.

The rear area 6 is integral at the two sides with each of the lateral areas 7 which are substantially opposite each other.

The locking portion 4 has a substantially planar lower profile 8 and an upper profile 9 jointed to the lower profile 8 in correspondence with a front edge 10 of the lateral areas 7.

Said jointing can be obtained with more or less accentuated curvature depending on design preferences.

The upper profile 9 has at least an area of first coupling 11 in which from the locking portion 4 a plurality of appendages 12 project substantially upwards. Different embodiments of the appendages 12 are provided: some in which the appendages 12 have a curvilinear profile, others with different profiles such as a saw tooth, as well as some in which the appendages 12 narrow from the base towards the summit, and others in which, on the contrary, they widen from the base upwards.

Figure 4:
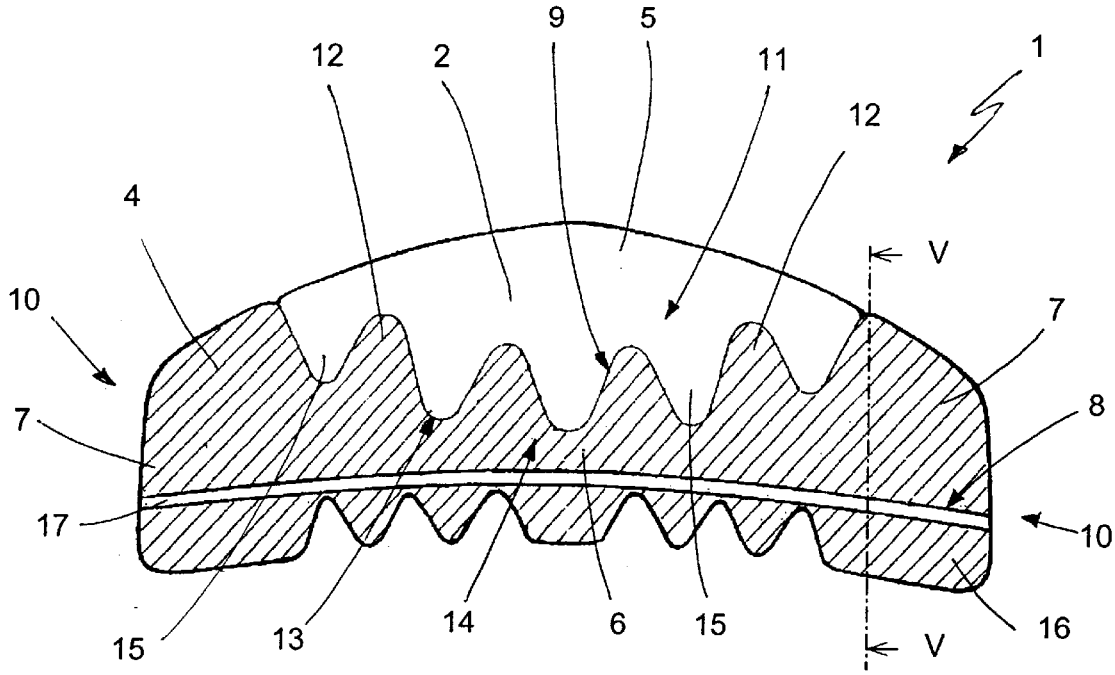
FIG. 4 shows a planar development of the buttress of FIG. 1.
Figure 5:
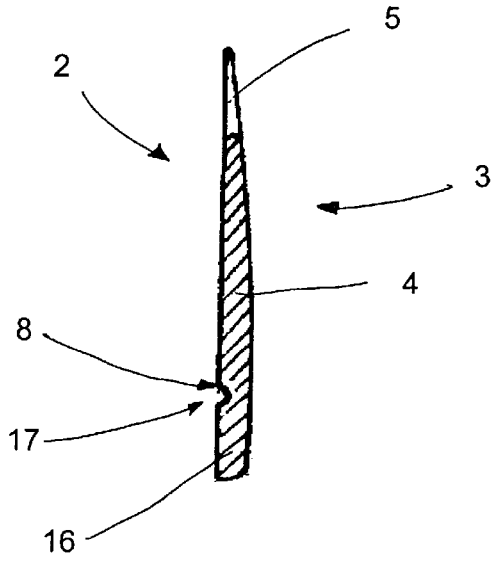
FIG. 5 is a partially sectioned view according to the trace V—V of FIG. 4.

In the case illustrated in the accompanying figures, the appendages 12 have a curvilinear profile and become narrower from the base towards the summit (FIG. 4).

The height of the appendages 12 can be constant, but, preferably, it is variable and it is greater the closer the appendages 12 are to the centre of the rear area 6.

The yielding portion 5 has lesser rigidity than the locking portion 4, with respect to which it has a more elastic behaviour.

The yielding portion 5 has a lower profile 13 whereon develops at least an area of second coupling 14 with substantially complementary shape to the area of first coupling 11.

In correspondence with the area of second coupling 14, also the yielding portion 5 has a plurality of appendages 15, in this case developing substantially downwards, and such as perfectly to fit in the spaces between the appendages 12 of the locking portion 4.

The area of second coupling 14 is coupled to the area of first coupling 11 of the upper profile 9 of the locking portion 4, whereto it is integrally fastened, in such a way that the combination of the two portions 4, 5 gives rise to a buttress 1 of substantially traditional shape.

In the embodiment illustrated in FIGS. 1 through 5, the area of first coupling 11 develops along the upper profile 9 substantially only in correspondence with the rear area 6, only marginally involving the two lateral areas 7.

Figure 8:
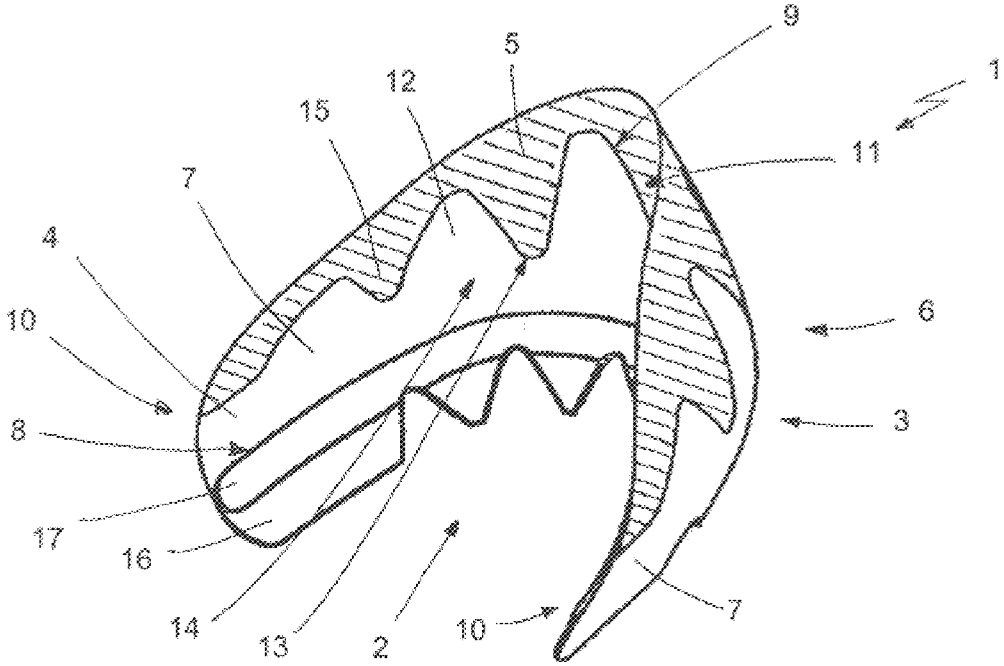
FIG. 8 shows a second embodiment of a buttress according to the present invention.

In the embodiment shown in FIG. 8, the area of first coupling 11 develops instead along the upper profile 9 in correspondence both with the rear area 6 and with the two lateral areas 7 reaching the front edge thereof.

It is also possible to envisage embodiments which are intermediate between the two described above.

Advantageously, the locking portion 4 has, in correspondence with the rear area 6, a decreasing average height towards the centre of the rear area 6 itself, whilst the yielding area 5 has increasing height from the sides towards the centre.

Globally in the illustrated embodiments, the buttress 1 has an increasing height from the front edges 10 towards the centre of the rear area 6 which is destined to be placed in correspondence with the heel, but this must not be taken as binding.

The buttress 1 further comprises at least a tab 16 fastened to the base of the locking area 4 to secure the buttress 1 to a shoe.

Figure 6:
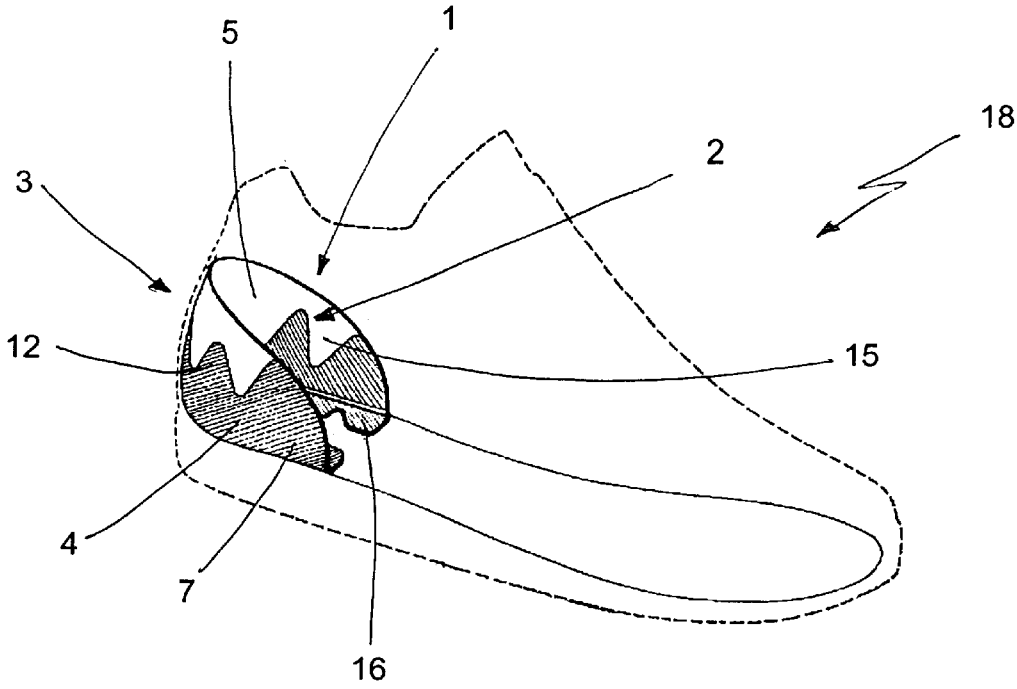
FIG. 6 shows a buttress according to the present invention mounted internally to the heel of a shoe.
Figure 7:
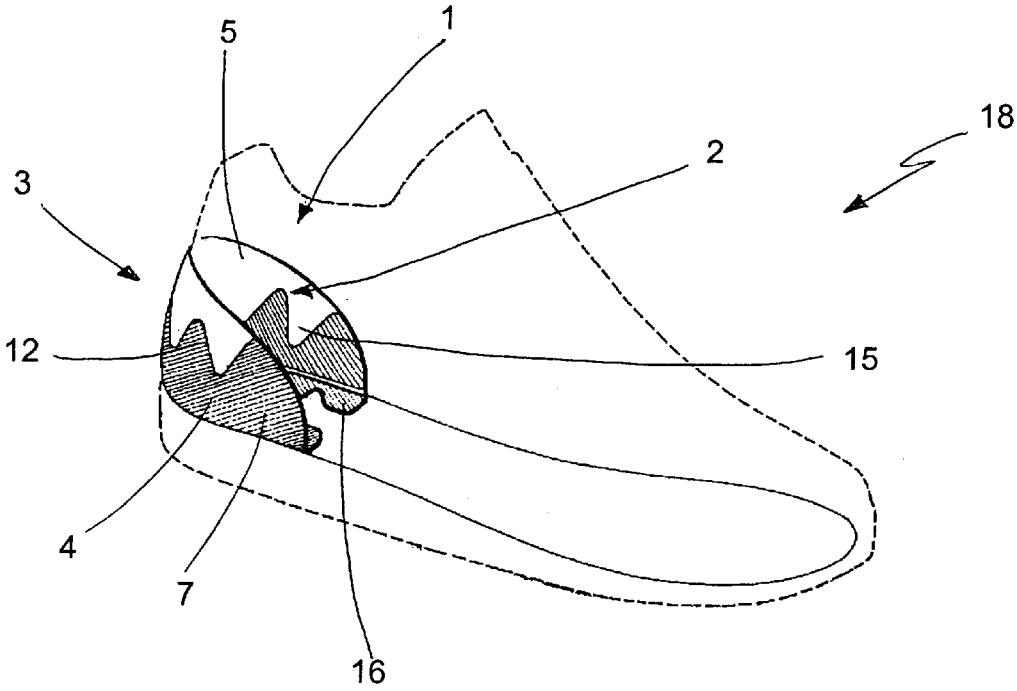
FIG. 7 shoes a buttress according to the present invention mounted externally to the heel of a shoe.

Said tab 16 can be bent from a first position in which it lies substantially on the continuation of the locking portion 4 (FIGS. 1–5) to a second position in which it extends substantially horizontally towards the interior of the buttress 1 itself (FIGS. 6 and 7).

In the preferred embodiment the tab 16 and the locking portion 4 constitute a single body.

The facilitate the bending, the tab 16 has a profile at least partially saw tooth shaped, and between the base of the locking portion 4 and the tab 16, on the inner face of the locking portion 4 itself, a groove 17 is obtained.

The materials constituting the locking portion 4 and the yielding portion 5 can be of any kind so long as they meet the aforesaid conditions of rigidity.

Advantageously, said materials can both be polymeric with different chemical compositions to differentiate their respective rigidity.

The union between the locking portion 4 and the yielding portion 5 (FIG. 4) can be obtained in any way.

If both portions 4, 5 are made of polymeric materials, their union can be obtained during the hot moulding of the buttress 1, injecting in succession the materials constituting the two portions 4, 5 into the same mould.

Figure 2:
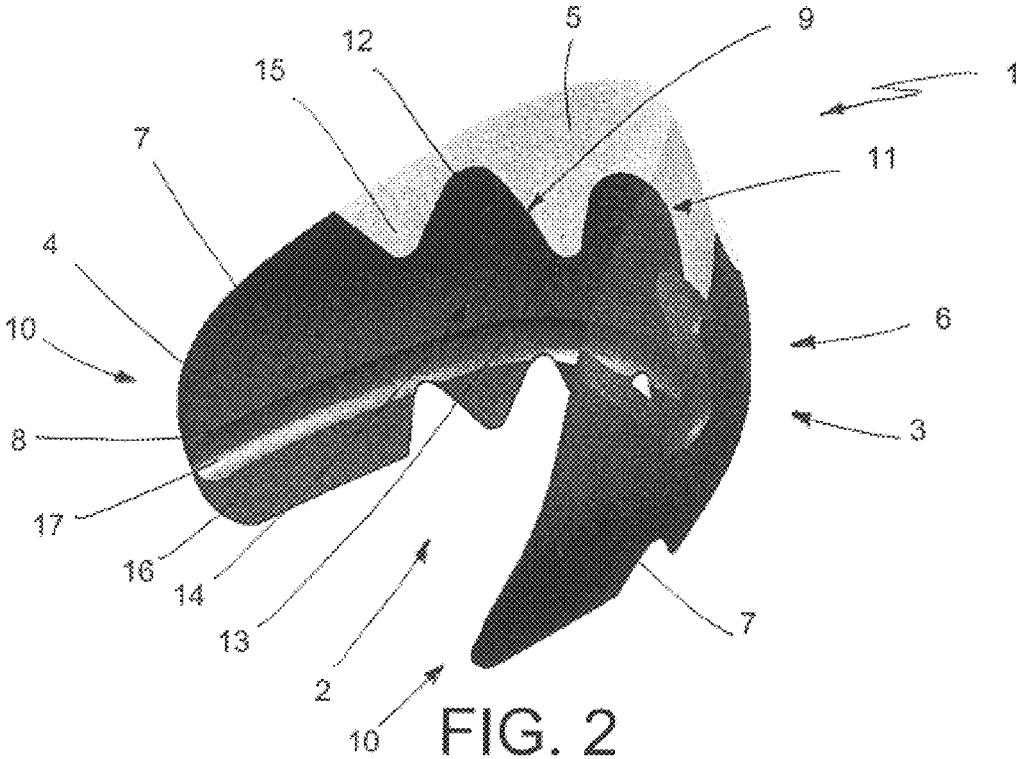
FIG. 2 is a perspective view of a buttress of FIG. 1 with some parts drawn in see-through mode, the better to highlight others.
Figure 3:
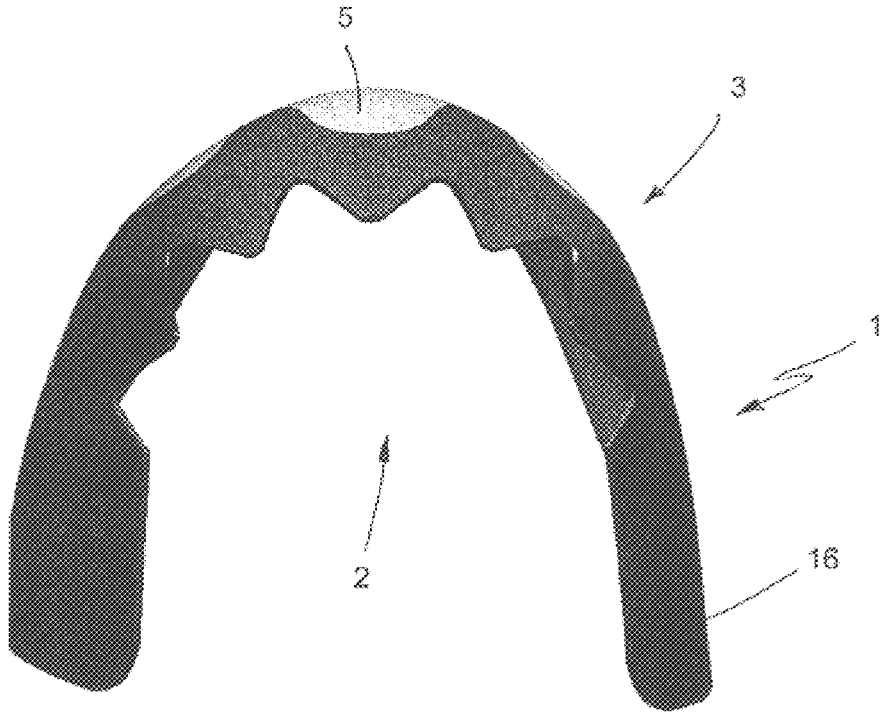
FIG. 3 is a bottom view of the buttress of FIG. 1 in operative condition.

The total thickness of the buttress 1 decreases from the bottom to the top, as shown in FIG. 2.

As FIGS. 6 and 7 show, the buttress 1 of the present invention can be mounted on a shoe 18 indifferently inside or outside the shoe.

In known manners the overall shape of the buttress 1 may be slightly different, depending on whether it is destined to be inserted in a shoe 18 for a right or left foot, the better to adapt to the anatomical conformation of the foot.

When a person uses a shoe 18 provided with the buttress 1 of the present invention, the latter prevents lateral movements of the heel of the foot mainly thanks to the contribution of the locking portion 4 and, in particular, of the lateral areas 7 thereof.

The movements of the ankle instead are not hampered by the buttress 1, thanks to the yielding portion 5.

The particular shape of the two portions guarantees an increasing flexibility of the buttress 1 from the bottom to the top.

Moreover, the greater flexibility is in correspondence with the area of the Achilles heel, where the mean height of the yielding portion is greatest.

The present invention achieves important advantages.

A person using a shoe fitted with the buttress simultaneously enjoys both a greater transverse rigidity which guarantees the foot's stability, and a soft support for the Achilles heel. In particular, therefore, the buttress of the present invention is suitable to be used also by persons suffering from Achilles heel pathologies, without having to forego the foot stability provided by traditional buttress.

Moreover, the buttress of the present invention is particularly well suited for sports shoes.

It should further be noted that the present invention is relatively easy to manufacture and that the cost connected with embodying the invention is not very high.

The invention thus conceived can be subject to numerous modifications and variations, without thereby departing from the scope of the inventive concept. All components can be replaced with technically equivalent elements and in practice all materials employed, as well as the shapes and the dimensions of the various parts, may be any depending on requirements.

What is claimed:

1. Buttress for shoes, able to be inserted in the heel area of a shoe, comprising:

a locking portion having an upper profile provided, at least in correspondence with an area of first coupling, with a plurality of appendages projecting substantially upwards;

a yielding portion, of less rigidity than the locking portion, and having a lower profile having at least an area of second coupling shaped in substantially complementary fashion and interlocked and coplanar with said area of first coupling of said upper profile of the locking portion;

said yielding portion being integrally fastened above said locking portion, and said buttress having in plan view a substantially horseshoe shaped development.

2. Buttress as claimed in claim 1, wherein said locking portion comprises a rear area and two lateral areas, said rear area being laterally integral with each of said lateral areas, said lateral areas being substantially opposite each other and engaged together only by said rear area, and said area of first coupling developing along the upper profile in correspondence with said rear area.

3. Buttress as claimed in claim 2, wherein said rear area has its height decreasing, on average, from its side near the lateral areas towards the centre of the rear area itself.

4. Buttress as claimed in claim 1, wherein said yielding area has increasing height from the sides towards the centre.

5. Buttress as claimed in claim 1, having increasing height from the sides towards the centre.

6. Buttress as claimed in claim 1, further comprising at least a tab fastened to the base of said locking area, and able to be bent from a first position in which it lies substantially on the downward continuation of said of said locking portion, to a second position in which it extends substantially horizontal towards the interior of the buttress itself.

7. Buttress as claimed in claim 6, wherein said tab has its profile at least partially undulated to facilitate the bending of the tab into the second position.

8. Buttress as claimed in claim 7, wherein said tab constitutes a single body with said locking portion.

9. Buttress as claimed in claim 8, wherein between said base of the locking portion and said tab is obtained a groove able to facilitate the bending of said tab relative to said locking portion from said first position to said second position.

* * * * *